US009865197B2

(12) United States Patent
Nebon et al.

(10) Patent No.: US 9,865,197 B2
(45) Date of Patent: Jan. 9, 2018

(54) METHOD FOR DETERMINING A REFRESH FREQUENCY FOR A MATRIX OF OLED ACTIVE PIXELS AND CORRESPONDING DEVICE

(71) Applicant: STMicroelectronics International N.V., Amsterdam (NL)

(72) Inventors: Jerome Nebon, Seyssins (FR); Jean-Marie Permezel, Grenoble (FR)

(73) Assignee: STMICROELECTRONICS INTERNATIONAL N.V., Schipol (NL)

( * ) Notice: Subject to any disclaimer, the term of this patent is extended or adjusted under 35 U.S.C. 154(b) by 136 days.

(21) Appl. No.: 14/797,354

(22) Filed: Jul. 13, 2015

(65) Prior Publication Data

US 2016/0078815 A1 Mar. 17, 2016

(30) Foreign Application Priority Data

Sep. 15, 2014 (FR) ..... 14 58632

(51) Int. Cl.
*G09G 3/3225* (2016.01)
*G09G 3/3258* (2016.01)

(52) U.S. Cl.
CPC ..... *G09G 3/3258* (2013.01); *G09G 3/3225* (2013.01); *G09G 2300/0413* (2013.01); *G09G 2320/0247* (2013.01); *G09G 2320/0261* (2013.01); *G09G 2320/043* (2013.01); *G09G 2340/0435* (2013.01); *G09G 2360/147* (2013.01)

(58) Field of Classification Search
CPC ..... G09G 3/3258; G09G 2320/043; G09G 2360/147; G09G 2320/0261
See application file for complete search history.

(56) References Cited

U.S. PATENT DOCUMENTS

2006/0149493 A1* 7/2006 Sambandan ..... G09G 3/3233 702/118
2013/0002312 A1* 1/2013 Yamazaki ..... G11C 19/28 327/109

FOREIGN PATENT DOCUMENTS

JP 2007164003 A 6/2007
KR 1020110044636 A 4/2011

OTHER PUBLICATIONS

INPI Search Report and Written Opinion for FR 1458632 dated Mar. 20, 2015 (9 pages).

* cited by examiner

*Primary Examiner* — Shaheda Abdin
(74) *Attorney, Agent, or Firm* — Gardere Wynne Sewell LLP

(57) ABSTRACT

A device includes an OLED pixel and a control circuit controlled at a refresh rate thereof. The device includes first and second dummy control circuits having similar operating characteristics to the control circuit. A controller and logic circuit switch on the first and second dummy control circuits and apply an input voltage so the first and second dummy control circuits output first and second output voltages. At a first time, the controller and logic circuit switch off the second dummy control circuit so a leakage current flows through the second dummy control circuit to ground, causing the second output voltage to reduce. Comparison circuitry determines a second time at which, due to the reduction of the second output voltage, a difference between the first and second output voltages is greater than a threshold. Determination circuitry determines the refresh frequency based upon elapsed time between the first and second times.

19 Claims, 2 Drawing Sheets

METHOD FOR DETERMINING A REFRESH FREQUENCY FOR A MATRIX OF OLED ACTIVE PIXELS AND CORRESPONDING DEVICE

RELATED APPLICATION

This application claims the benefit and priority of French Application No. 1458632, filed Sep. 15, 2014, the contents of which are hereby incorporated by reference in their entirety.

TECHNICAL FIELD

Various embodiments described herein relate to devices equipped with a matrix or matrices of active OLED pixels, and more precisely to the determination of the refresh frequency of these matrices of active OLED pixels.

BACKGROUND

Devices are known in the prior art in which organic light-emitting diodes, more simply denoted by the term "OLED diodes", are controlled at a refresh frequency by control circuits comprised of transistors. Such control circuits allow a voltage to be applied across the terminals of the OLED diodes after a refresh operation, and for this voltage to be maintained until the next refresh operation. This is made possible by using the capacitance associated with NMOS transistors which are respectively coupled to anodes of the OLED diodes.

The control circuits include other MOS transistors which act as switches. These transistors are conducting during the refresh operation (which has a short duration), then are in a non-conducting state when the voltage is maintained between refresh operations. Current leakages may nevertheless appear within these transistors acting as a switch.

The effect of these leakage currents causes a drop in the voltage across the terminals of the OLED diodes, which progressively decreases starting from the moment when the transistors acting as switches go into the non-conducting state.

This drop in the voltage across the terminals of the OLED diodes is associated with a reduction in the light intensity emitted by the OLED diodes. If this reduction in light intensity is too great between two refresh operations, it may be noticed by the user looking at the matrix of active OLED pixels. This phenomenon is commonly denoted by those skilled in the art by the term "flicker".

The period between two refresh operations is associated with a refresh frequency. In order to limit the appearance of the flicker phenomenon, those skilled in the art know that it is preferable to use a high refresh frequency, for example 50 or 60 Hz. These refresh frequencies have the drawback of being associated with an increase in electrical power consumption.

SUMMARY

According to one embodiment, a determination is made of a refresh frequency, allowing the appearance of the flicker phenomenon to be limited.

The inventors have observed that, by determining the period of time starting from which a decrease in brightness becomes noticeable, a refresh frequency may be deduced at which flicker is rendered imperceptible. This refresh frequency may be lower than the frequencies generally used, but still without the flickering being noticeable.

According to one aspect, a method is thus provided for determining a refresh frequency for a matrix of OLED active pixels, having, for each pixel, a control circuit controllable at the refresh frequency. The method includes a simultaneous control, at a first moment in time, of first and second dummy control circuits analogous to the control circuit. The control of the first dummy control circuit includes the application of a first voltage to the input of the first dummy control circuit in such a manner so as to obtain a first output voltage. The control of the second dummy control circuit includes the application of the first voltage to the input of the second dummy control circuit, then the placing of the second dummy control circuit into a leaky state, in such a manner as to obtain a second output voltage. The method also includes a determination of the period of time separating the first moment in time from a second moment in time at which the difference between the first and second output voltages reaches a threshold, so as to facilitate deduction of the refresh frequency.

By maintaining the first voltage on the input of the first dummy control circuit, the first output voltage remains constant and equal to the voltage across the terminals of an OLED diode of the matrix of active pixels while it is being refreshed.

Putting the second dummy control circuit into a leaky state allows the second dummy control circuit to be placed in a state similar to that of a control circuit having just been refreshed.

The threshold may be chosen such that it corresponds to a reduction in the voltage across the terminals of an OLED diode which produces a noticeable reduction in light intensity.

As soon as this threshold is reached, the period corresponding to the time between the first and the second moments in time is inverted and this period of time corresponds to the refresh frequency sought: the lowest frequency that allows the flicker phenomenon to be rendered imperceptible.

The time between the first and the second moment in time can be directly determined in order to deduce the refresh frequency. A mapping could be used that has as input the period of time determined and as output a refresh frequency. Frequency determination algorithms might also be used.

The control of the second circuit can include the charging of a capacitance associated with an NMOS transistor and the placement into a leaky state includes the discharging of this capacitance.

"A capacitance associated with an NMOS transistor" shall be understood to mean the gate capacitance formed between the gate and the substrate of the transistor as separated by a gate oxide.

According to another aspect, a device is provided and includes a matrix of OLED active pixels. For each pixel, a control circuit is associated therewith and designed to be controlled at a refresh frequency. The device also includes first and second dummy control circuits analogous to the control circuit, and a controller configured for simultaneously controlling, at a first moment in time, the first dummy pixel circuit and the second dummy pixel circuit. The controller is configured for controlling the first dummy pixel circuit by applying a first voltage to the input thereof in such a manner as to obtain a first output voltage, and for controlling the second dummy pixel circuit by applying the first voltage to the input thereof and then placing the second dummy pixel circuit into a leaky state in such a manner as to obtain a second output voltage. The device also includes a determination circuit configured for determining the period of time separating the first moment in time from a second moment in time at which the difference between the first and second output voltages reaches a threshold, and configured for deducing from this the refresh frequency for the matrix of active OLED pixels.

The controller can be configured for controlling the second dummy pixel circuit by charging a gate capacitance associated with an NMOS transistor of the second circuit, and the placement into a leaky state includes the discharging of this gate capacitance.

The first dummy pixel control circuit and the second dummy pixel control circuit can each include a first NMOS transistor having its source forming the input of the dummy pixel control circuit and its drain coupled to the gate of a second NMOS transistor having its source forming the output of the dummy pixel control circuit.

Such a circuit corresponds to a pixel control circuit of a conventional OLED matrix, which allows leakage currents corresponding to those of the matrix of pixels to be observed.

The controller can include a circuit configured for placing the second control circuit into a leaky state. The circuit includes a first NMOS transistor having its source designed to receive the first voltage, its drain coupled to the input of the second control circuit, and a second NMOS transistor coupled between the input of the second control circuit and ground.

BRIEF DESCRIPTION OF THE DRAWINGS

Other advantages and features of this disclosure will become apparent upon examining the detailed description of non-limiting embodiments and appended drawings, in which.

DETAILED DESCRIPTION

Figure 1:
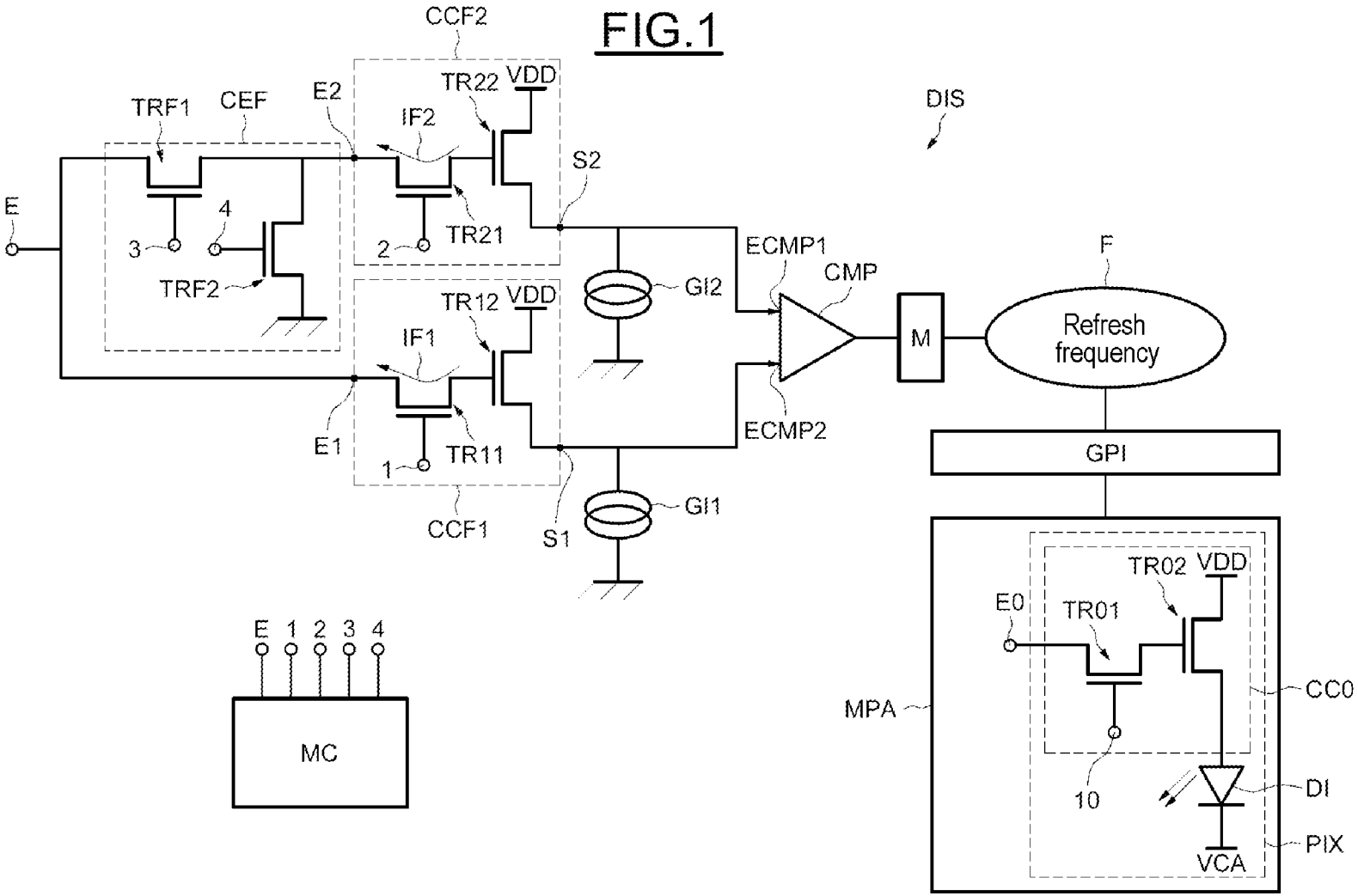
FIG. 1 is a circuit diagram of a device according to one embodiment.

FIG. 1 shows a device DIS having a matrix of active OLED pixels MPA. The matrix of active OLED pixels MPA has active pixels PIX, which each are comprised of an OLED diode DI and a control circuit CC0. The control circuit for each pixel of the matrix of active OLED pixels MPA is controlled at a refresh frequency F, which is supplied to a logic circuit GPI for management of the pixels. This management circuit GPI controls lines for selecting rows of the matrix of pixels and lines which are designed to supply a voltage to the input of the control circuits of the pixels in order to refresh them.

For the purposes of simplification, one active pixel PIX of the matrix of pixels MPA has been shown.

The control circuit CC0 includes a first NMOS transistor TR01 and a second NMOS transistor TR02. The OLED diode DI is designed to receive at its cathode a cathode voltage VCA, which is the same for other cathodes of diodes of the matrix of active OLED pixels MPA. The anode of the OLED diode DI is coupled to the control circuit CC0, and more precisely to the source of the second NMOS transistor TR02. The second transistor TR02 has its drain coupled to a power supply line VDD and its gate coupled to the drain of the first NMOS transistor TR01, which has its source forming the input E0 of the control circuit CC0. The input E0 is controlled by the logic circuit for management of the pixels GPI, and this is also the case for the gate 10 of the first NMOS transistor TR01.

The device DIS includes a first dummy control circuit CCF1 and a second dummy control circuit CCF2. These dummy control circuits CCF1 and CCF2 are analogous to the control circuits CC0 of the active pixels of the matrix of active OLED pixels MPA. Thus, they include the same or similar components and are configured in the same or similar way. The dummy control circuits CCF1 and CCF2 are not, however, coupled to OLED diodes.

The first dummy control circuit CCF1 includes a first NMOS transistor TR11 having its source forming the input E1 of the first control circuit CCF1 and its drain coupled to the gate of a second NMOS transistor TR12, the source of which forms the output S1 of the first dummy control circuit. The drain of the second NMOS transistor TR12 is coupled to the power supply line VDD.

The second dummy control circuit CCF2 comprises a first NMOS transistor TR21 having its source forming the input E2 of the second control circuit CCF2 and its drain coupled to the gate of a second NMOS transistor TR22, the source of which forms the output S2 of the second dummy control circuit. The drain of the second NMOS transistor TR22 is coupled to the power supply line VDD.

In the dummy control circuits CCF1 and CCF2, the first NMOS transistors allow a voltage level to be passed from the input of the dummy control circuit to charge a gate capacitance associated with each of the second NMOS transistors, in other words the capacitor formed between the gate and the substrate of the second NMOS transistor.

When a voltage is held by the gate capacitance associated with a second NMOS transistor, an output voltage appears at the sources of these transistors, in other words at the output S1 of the first dummy control circuit CCF1 and at the output S2 of the second dummy control circuit CCF2.

When a first voltage is applied to the input E of the device, this voltage can be transmitted to the gate of the second NMOS transistor TR12 of the first dummy control circuit which will maintain this voltage by virtue of its gate capacitance. The first NMOS transistor TR11 is then controlled in a conducting state for at least a particularly short lapse of time for stabilization to allow transmission of the first voltage to the gate of the second NMOS transistor TR12 and the charging of its gate capacitance.

By maintaining the first voltage on the input E of the device, and on the input E1 of the first dummy control circuit CCF1, the flow of a leakage current IF1 through the transistor TR11 is prevented. The voltage maintained by virtue of the gate capacitance associated with the transistor TR11 is therefore conserved. This is also the case for the first output voltage obtained at the point S1.

The device further includes a circuit CEF configured for placing the second dummy control circuit CCF2 into a leaky state. The circuit CEF comprises an NMOS transistor TRF1 having its source coupled to the input E of the device and its drain coupled to the drain of an NMOS transistor TRF2, the source of which is coupled to ground. The common point of the transistors TRF1 and TRF2 is coupled to the input E2 of the second dummy control circuit CCF2.

In order to control the ON and OFF states of the transistors TR11, TR21, TRF1 and TRF2, their gates, respectively referenced 1, 2, 3 and 4 in the figure, are controlled by suitably configured logic control circuitry MC. This control circuit can also apply a first voltage to the input E of the device.

The logic circuitry MC is configured for simultaneously controlling, at a first moment in time, the first dummy pixel circuit CCF1 and the second dummy pixel circuit CCF2.

More precisely, the logic circuitry MC is configured for controlling the first dummy control circuit CCF1 by applying the first voltage to the input E1 of the circuit in order to obtain the first output voltage. For this purpose, the gate 1 of the first NMOS transistor TR11 is controlled such that this transistor is conducting.

The logic circuitry MC is configured for controlling the second dummy control circuit CCF2 by applying the first voltage to the input E2 of the second circuit for a very short period of time for stabilization, then by placing the second circuit into a leaky state, in such a manner as to obtain a second output voltage. For this purpose and during this very short period of time for stabilization, the gate 2 of the first NMOS transistor TR21 is controlled such that this transistor is conducting, the gate 4 of the NMOS transistor TRF2 is controlled such that this transistor is turned off, and the gate 3 of the transistor TRF1 is controlled such that this transistor is conducting. At the expiration of the very short period of time for stabilization, the gate 3 of the transistor TRF1 is controlled such that this transistor is turned off, the gate 4 of the transistor TRF2 is controlled such that this transistor is conducting, and the gate 2 of the first NMOS transistor TR21 is controlled such that this transistor is turned off, as is the case for such a pixel transistor which has just been refreshed. A leakage current IF2 can then flow through the first NMOS transistor TR21 to ground. For this reason, the voltage maintained on the gate of the transistor TR22 can drop, and this is also the case for the second output voltage obtained at the output S2 of the second dummy control circuit CCF2.

At the expiration of the very short period of time for stabilization, and in order to achieve an operation similar to that of a pixel of the matrix, the first NMOS transistor TR11 is also controlled by its gate 1 in a non-conducting state, so the control of this gate is the same as that of the gate of the first NMOS transistor TR12.

The logic circuitry MC can include one or more logic circuits, or any other circuit suitable for applying gate voltages to control transistors to be in ON or OFF states.

It may be noted that the time variation of the second output voltage corresponds to the time variation of the voltage across the terminals of the OLED diode DI of the matrix of active OLED pixels MPA after a command has been applied to its control circuit.

The first and second output voltages are compared by a comparator CMP. A current generator GI1 is coupled between the output S1 of the first dummy control circuit CCF1 and the corresponding input ECMP1 of the comparator CMP. In the same way, a current generator GI2 is coupled between the output S2 of the second dummy control circuit CCF2 and the corresponding input ECMP2 of the comparator CMP. The current generators GI1 and GI2 allow the second transistors NMOS TR12 and TR21 to be biased so that they operate in a source follower mode.

The device DIS includes determining circuitry M configured for determining the period of time separating a first moment in time starting from which the two dummy control circuits have been simultaneously controlled, and a second moment in time where the difference obtained at the output of the comparator CMP reaches a threshold. This may notably be carried out by determining the period of time separating the first moment in time from the second moment in time.

This determining circuitry M can include a logic circuit or any other circuit suitable for determining this period, for example a comparator or a counter. This threshold can correspond to a voltage drop that is sufficiently high for flicker to be noticeable by the human eye observing the matrix of OLED active pixels.

The determining circuitry M is furthermore configured for deducing from this period the refresh frequency F for the matrix of OLED pixels MPA. This may be carried out by mapping or by using algorithms for frequency determination.

More precisely, taking into account a desired voltage drop across the terminals of the diode, this period of time provides an approximation to the first order of the slope of the time variation of the diode voltage as a function of the refresh frequency. Taking into account the characteristics of the OLED diode, the reduction in brightness may be deduced from the voltage drop, and consequently a first approximation of the refresh frequency may be obtained from the ratio between the reduction in brightness and the slope. This first approximation is subsequently corrected with a correction factor taking into account the sensitivity of the human eye at various frequencies. Such correction factors are for example available in the standard VESA IDMS (Informative Display Measurement Standard) version 1.03, which is hereby incorporated by reference in its entirety.

In other words, the combination of the slope, the characteristics of the OLED diode, and the sensitivity of the human eye as a function of frequency, supplies a mapping allowing the desired refresh frequency to be determined for a measured period of time.

This refresh frequency is subsequently supplied to the management circuit for the pixels GPI which manages the matrix of pixels MPA by applying commands to the circuits for controlling the pixels at the refresh frequency F.

Figure 2:
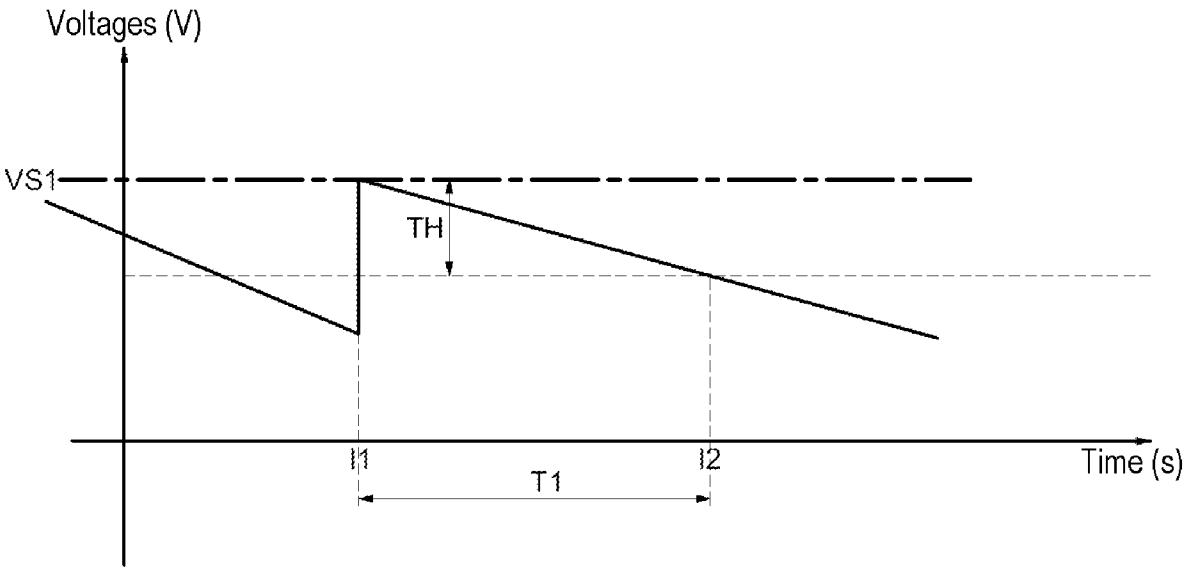
FIG. 2 is a diagram illustrating the time variation of the output voltages from the dummy control circuits of FIG. 1.

FIG. 2 is a diagram illustrating the time variation of the output voltages of the dummy control circuits CCF1 and CCF2. In this figure, the mixed dashed line corresponds to the output voltage VS1 at the point S1, in other words at the output of the first dummy control circuit CCF1. This value VS1 is constant since no leak can appear within this control circuit.

The solid line curve corresponds to the output voltage at the point S2, in other words at the output of the second dummy control circuit CCF2. At a first moment in time I1, a command is applied to this second control circuit and the input voltage of the device is applied to the gate of the second NMOS transistor TR22 which delivers at the output a voltage equal to that obtained at the output of the first dummy control circuit CCF1.

This application of a voltage is implemented for a very short stabilization time, and subsequently the circuit is no longer controlled, and the voltage is maintained owing to the MOS capacitance associated with the second NMOS transistor TR22.

It is also after the application of the voltage for a very short stabilization time that a command is applied to the circuit CEF configured for placing the second control circuit CCF2 in a leaky state. These leaks cause a drop in the output voltage of the second dummy control circuit.

At the time I2, the difference between the output voltages exceeds the threshold TH, and the time period T1 separates the two moments in time. The determination of the refresh frequency may be implemented at any time during the operation of the device.

According to one aspect, a refresh frequency is obtained that is the lowest possible for an observer not to notice the flicker, which allows the consumption of electrical power to be limited.

The various embodiments described herein are well adapted to the displaying of fixed images by matrices of OLED active pixels.

The invention claimed is:

1. A method for determining a refresh frequency for a matrix of active OLED pixels, comprising:

controlling first and second dummy control circuits at a first time, the first and second dummy control circuits each being a replica of a control circuit for the active OLED pixels;

wherein controlling the first dummy control circuit comprises applying a first voltage to an input thereof so as to obtain a first output voltage therefrom;

wherein controlling the second dummy control circuit comprises applying the first voltage to an input thereof, and operating the second dummy control circuit such that a leakage current flows therethrough, so as to obtain a second output voltage;

determining an elapsed time separating the first time from a second time at which a difference between the first and second output voltages is greater than a threshold; and determining the refresh frequency from the elapsed time.

2. The method of claim 1, wherein controlling the second dummy control circuit further comprises charging a gate capacitance associated with an NMOS transistor; and wherein operating the second dummy control circuit such that a leakage current flows therethrough comprises discharging the gate capacitance.

3. A device, comprising:

a matrix of active OLED pixels having a control circuit configured to be controlled at a refresh frequency;

first and second dummy control circuits each being a replica of the control circuit;

a controller configured to control the first and second dummy control circuits at a first time, wherein the controller controls the first dummy control circuit by applying a first voltage to an input of the first dummy control circuit so as to obtain a first output voltage, and controls the second dummy control circuit by applying the first output voltage to an input of the second dummy control circuit and operating the second dummy control circuit such that a leakage current flows therethrough, so as to obtain a second output voltage, determining circuitry configured to determine an elapsed time separating the first time from a second time at which a difference between the first and second output voltages is greater than a threshold, and determine the refresh frequency of the matrix of active OLED pixels based upon the elapsed time.

4. The device of claim 3, wherein the controller is configured to control the second dummy control circuit by charging a gate capacitance associated with an NMOS transistor thereof and to operate the second dummy control circuit such that the leakage current flows therethrough by discharging the gate capacitance.

5. The device of claim 3, wherein the first and second dummy control circuits each comprise a first NMOS transistor having a source forming the input of its respective dummy control circuit and a drain coupled to a gate of a second NMOS transistor having a source forming an output its respective dummy control circuit.

6. The device of claim 3, wherein the controller includes:

a circuit configured for operating the second dummy control circuit such that the leakage current flows therethrough;

a first NMOS transistor having a source configured to receive the first voltage and a drain coupled to the input of the second dummy control circuit; and a second NMOS transistor coupled between the input of the second dummy control circuit and ground.

7. A device, comprising:

at least one OLED pixel;

a control circuit for controlling a refresh rate of the at least one OLED pixel;

first and second dummy control circuits, each having substantially similar operating characteristics to the control circuit;

a controller and a logic circuit cooperating therewith, the controller and logic circuit configured to:

switch on the first and second dummy control circuits and apply an input voltage thereto such that the first and second dummy control circuits output first and second output voltages respectively, and at a first time, switch off the second dummy control circuit such that a leakage current flows through the second dummy control circuit to ground, causing the second output voltage to change, comparison circuitry configured to determine a second time at which, due to the change in the second output voltage, a difference between the first output voltage and the second output voltage is greater than a threshold; and determination circuitry configured to determine the refresh rate based upon an elapsed time between the first time and the second time.

8. The device of claim 7, wherein the first and second dummy control circuits each comprise:

a first NMOS transistor having a source coupled to the controller, a drain, and a gate coupled to the logic circuit; and a second NMOS transistor having a drain coupled to a supply voltage, a source coupled to the comparison circuitry, and a gate coupled to the drain of the first NMOS transistor.

9. The device of claim 8, wherein the controller comprises:

a first NMOS transistor having a source coupled to receive the input voltage, a drain coupled to the second dummy control circuit via a node, and a gate coupled to the logic circuit; and a second NMOS transistor having a drain coupled to the node, a source coupled to ground, and a gate coupled to the logic circuit.

10. The device of claim 9, wherein the logic controller switches on the first and second dummy control circuits by applying a switch-on voltage to the gates of transistors thereof; and wherein the logic controller is configured to, at the first time:

apply a switch-off voltage to the gate of the first NMOS transistor of the controller, apply a switch-on voltage to the gate of the second NMOS transistor of the controller, and apply the switch-off voltage to the gate of the first NMOS transistor of the second dummy control circuit.

11. The device of claim 10, wherein a capacitance at the gate of the second NMOS transistor of the second dummy control circuit is charged when the logic controller applies the switch-on voltage to the gate of the second NMOS transistor of the second dummy control circuit, and discharged when the logic controller applies the switch-off voltage to the gate of the second NMOS transistor of the second dummy control circuit.

12. The device of claim 10, wherein the logic circuit is further configured to, at the first time, apply the switch-off voltage to the gate of the first NMOS transistor of the first dummy control circuit.

13. The device of claim 12, wherein application of the input voltage to the source of the first NMOS transistor of the first dummy control circuit by the controller prevents discharge of capacitance between the gate and body of the second NMOS transistor of the first dummy control circuit when the logic controller applies the switch-off voltage to the gate of the first NMOS transistor of the first dummy control circuit.

14. The device of claim 7, wherein the comparison circuit comprises a comparator.

15. The device of claim 7, wherein the determination circuitry comprises a processor.

16. A device, comprising:

at least one OLED pixel;

a control circuit for controlling the at least one OLED pixel;

first and second dummy control circuits, each having substantially similar operating characteristics to the control circuit;

a controller and a logic circuit cooperating therewith, the controller and logic circuit configured to_switch on the first and second dummy control circuits such that the first and second dummy control circuits output first and second output voltages respectively and apply an input voltage thereto, and at a first time, switch off the second dummy control circuit;

comparison circuitry coupled to outputs of the first and second dummy control circuits and configured to determine a second time at which a difference between the first output voltage and the second output voltage is greater than a threshold; and refresh frequency determination circuitry coupled to the comparison circuitry and configured to determine a refresh rate for the at least one OLED pixel based upon an elapsed time between the first time and the second time.

17. The device of claim 16, wherein the first and second dummy control circuits each comprise:

a first NMOS transistor having a source coupled to the controller, a drain, and a gate coupled to the logic circuit; and a second NMOS transistor having a drain coupled to a supply voltage, a source coupled to the comparison circuitry, and a gate coupled to the drain of the first NMOS transistor.

18. The device of claim 17, wherein the controller comprises:

a first NMOS transistor having a source coupled to receive the input voltage, a drain coupled to the second dummy control circuit via a node, and a gate coupled to the logic circuit; and a second NMOS transistor having a drain coupled to the node, a source coupled to ground, and a gate coupled to the logic circuit.

19. The device of claim 18, wherein the logic controller switches on the first and second dummy control circuits by applying a switch-on voltage to the gates thereof; and wherein the logic controller is configured to, at the first time:

apply a switch-off voltage to the gate of the first NMOS transistor of the controller, apply a switch-on voltage to the gate of the second NMOS transistor of the controller, and apply the switch-off voltage to the gate of the first NMOS transistor of the second dummy control circuit.

* * * * *